US007751743B2

(12) United States Patent
Kamimura et al.

(10) Patent No.: US 7,751,743 B2
(45) Date of Patent: Jul. 6, 2010

(54) DEVELOPER CARTRIDGE, PROCESS CARTRIDGE AND IMAGE-FORMING DEVICE

(75) Inventors: Naoya Kamimura, Nagoya (JP); Yuichi Matsushita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 617 days.

(21) Appl. No.: 11/410,965

(22) Filed: Apr. 26, 2006

(65) Prior Publication Data

US 2006/0245783 A1 Nov. 2, 2006

(30) Foreign Application Priority Data

Apr. 27, 2005 (JP) ..... 2005-130200

(51) Int. Cl.
*G03G 15/08* (2006.01)

(52) U.S. Cl. ..... 399/103

(58) Field of Classification Search ..... 399/102, 399/103, 106, 105

See application file for complete search history.

(56) References Cited

U.S. PATENT DOCUMENTS 5,502,547 A * 3/1996 Shirai ..... 399/102
6,021,291 A 2/2000 Karakama et al.
6,487,383 B2 * 11/2002 Buchanan et al. ..... 399/103
6,901,228 B2 * 5/2005 Kamimura et al. ..... 399/103
2002/0141778 A1 * 10/2002 Itabashi ..... 399/103
2003/0123899 A1 * 7/2003 Kamimura ..... 399/103
2007/0140729 A1 * 6/2007 Carter et al. ..... 399/103

FOREIGN PATENT DOCUMENTS

JP 9-269657 10/1997
JP 10-198164 7/1998
JP 2000-242079 9/2000
JP 2000-284591 10/2000
JP 2001-134082 5/2001
JP 2004-317643 11/2004

* cited by examiner

*Primary Examiner*—David M Gray
*Assistant Examiner*—Joseph S Wong
(74) *Attorney, Agent, or Firm*—Banner & Witcoff, Ltd

(57) ABSTRACT

A developer cartridge includes a developer roller, a support member and a first seal member. The developer roller has a rotational axis and a peripheral surface. The peripheral surface includes a center zone and an end zone at one end portion in an axial direction. The support member supports the developer roller to be rotatable about the rotational axis. The support member has an opposing surface opposed to the end zone. A protrusion protrudes from the opposing surface, and extends in a direction crossing with the axial direction. The first seal member is disposed between the end zone and the opposing surface in order to prevent developer from leaking out of a space formed between the end zone and the opposing surface.

32 Claims, 7 Drawing Sheets

26

DEVELOPER CARTRIDGE, PROCESS CARTRIDGE AND IMAGE-FORMING DEVICE

CROSS REFERENCE TO RELATED APPLICATIONS

This application claims priority to Japanese Patent Application No. 2005-130200 filed on Apr. 27, 2005, the contents of which are hereby incorporated by reference into the present application.

TECHNICAL FIELD

The present invention relates to an image-forming device such as a laser printer, and a developer cartridge and process cartridge mounted in the image-forming device.

BACKGROUND

Image-forming devices such as laser printers have conventionally been provided with a developer cartridge detachably mounted therein for supplying a developer to the surface of a photosensitive drum in the image-forming device.

The developer cartridge is commonly configured of a casing for accommodating developer, and a developing roller rotatably supported in the casing for carrying developer within the casing. The casing also has an elongated opening formed therein. The developing roller is disposed so that a portion of the roller is exposed through the opening to confront the surface of a photosensitive drum disposed in the image-forming device. As the developing roller rotates, developer from the casing carried on the surface of the developing roller comes into contact with the surface of the photosensitive drum. At this time, the developer is attracted to an electrostatic latent image formed on the surface of the photosensitive drum in order to develop the image into a developer image. Subsequently, the developer image is transferred onto a sheet of paper, forming an image on the paper.

This type of developer cartridge has been conventionally provided with sealing members disposed between each end of the developing roller and the casing to prevent developer from leaking therethrough. When the sealing member are fixed to the casing with double-sided tape or adhesive, remnants of the double-sided tape or adhesive remain on the casing after the sealing members are peeled therefrom. Accordingly, extra effort is required when recycling (reusing) the developing cartridge as the sealing members are replaced with new members.

Therefore, Japanese unexamined patent application publication No. HEI-9-269657 proposes a technique for mounting sealing members on the housing of the developing device. According to this technique, fitting parts are formed in the housing such that the sealing members can be fittingly inserted into the fitting parts. Protruding parts extending in a direction parallel to the axial direction of the developing roller (a direction orthogonal to the rotating direction of the developing roller) are formed on each fitting part to prevent the sealing members from shifting from the mounted position as the developing roller rotates.

However, in the proposed structure described above, since the sealing members are not fixed to the fitting parts with double-sided tape or adhesive, a gap may be formed between the sealing member and the fitting part as the developing roller rotates, risking the chance that developer may enter this gap and leak out of the housing along the protruding parts.

SUMMARY

In view of the foregoing, it is an object of the present invention to provide a developer cartridge, process cartridge, and image-forming device capable of reliably preventing developer from leaking between the ends of the developing roller and the casing.

In order to attain the above and other objects, the present invention provides a developer cartridge includes a developer roller, a support member and a first seal member. The developer roller has a rotational axis and a peripheral surface. The peripheral surface includes a center zone and an end zone at one end portion in an axial direction. The support member supports the developer roller to be rotatable about the rotational axis. The support member has an opposing surface opposed to the end zone. A protrusion protrudes from the opposing surface, and extends in a direction crossing with the axial direction. The first seal member is disposed between the end zone and the opposing surface in order to prevent developer from leaking out of a space formed between the end zone and the opposing surface.

Another aspect of the present invention provides a process cartridge including the above-described developer cartridge and an image-bearing member on which the toner is provided from the developer cartridge.

Another aspect of the present invention provides an image-forming device including the above-described developer cartridge and a body mountable the developer cartridge.

Another aspect of the present invention provides an image-forming device including the above-described process cartridge and a body mountable the process cartridge.

Another aspect of the present invention provides a developer cartridge including a developer roller, a support member and a first seal member. The developer roller has a rotational axis and a peripheral surface. The peripheral surface includes a center zone and an end zone at one end portion in an axial direction. The support member supports the developer roller to be rotatable about the rotational axis. The support member has an opposing surface opposed to the end zone. The opposing surface is formed with a protrusion having a first end and a second end farther from the central zone than the first end in the axial direction. The first end of the protrusion is formed in an upstream side of the second end of the protrusion with respect to a rotational direction of the developer roller. The first seal member is disposed between the end zone and the opposing surface in order to prevent developer from leaking out of a space formed between the end zone and the opposing surface.

Another aspect of the present invention provides a process cartridge including the above-described developer cartridge and an image-bearing member on which the toner is provided from the developer cartridge.

Another aspect of the present invention provides an image-forming device including the above-described developer cartridge and a body mountable the developer cartridge.

Another aspect of the present invention provides an image-forming device including the above-described process cartridge and a body mountable the process cartridge.

Another aspect of the present invention provides a developer cartridge including a developer roller, a support member and a first seal member. The developer roller has a rotational axis and a peripheral surface. The peripheral surface includes a center zone and an end zone at one end portion in an axial direction. The support member supports the developer roller to be rotatable about the rotational axis. The support member has an opposing surface opposed to the end zone. The opposing surface is formed with a protrusion having a first end and a second end. A virtual straight line connecting the first end to the second end is orthogonal to the axial direction. The first seal member is disposed between the end zone and the opposing surface in order to prevent developer from leaking out of a space formed between the end zone and the opposing surface.

Another aspect of the present invention provides a process cartridge including the above-described developer cartridge and an image-bearing member on which the toner is provided from the developer cartridge.

Another aspect of the present invention provides an image-forming device including the above-described developer cartridge and a body mountable the developer cartridge.

Another aspect of the present invention provides an image-forming device including the above-described process cartridge and a body mountable the process cartridge.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

Figure 1:
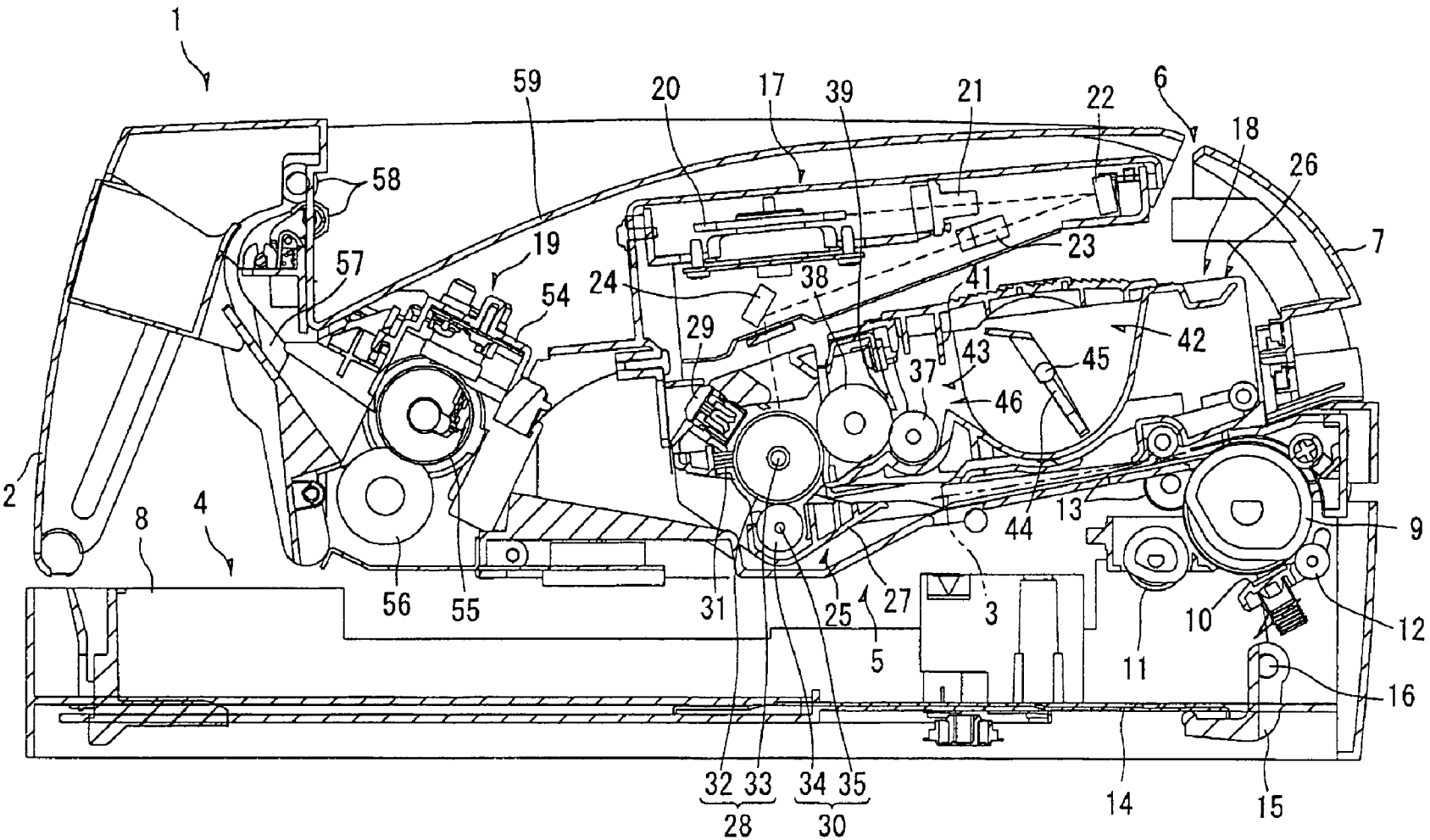
FIG. 1 is a side cross-sectional view of a laser printer according to a preferred embodiment of the present invention, when a cover is in a closed state.

A developer cartridge, a process cartridge and an image-forming device according to preferred embodiments of the present invention will be described while referring to the accompanying drawings wherein like parts and components are designated by the same reference numerals to avoid duplicating description.

1. General Structure of a Laser Printer

Figure 2:
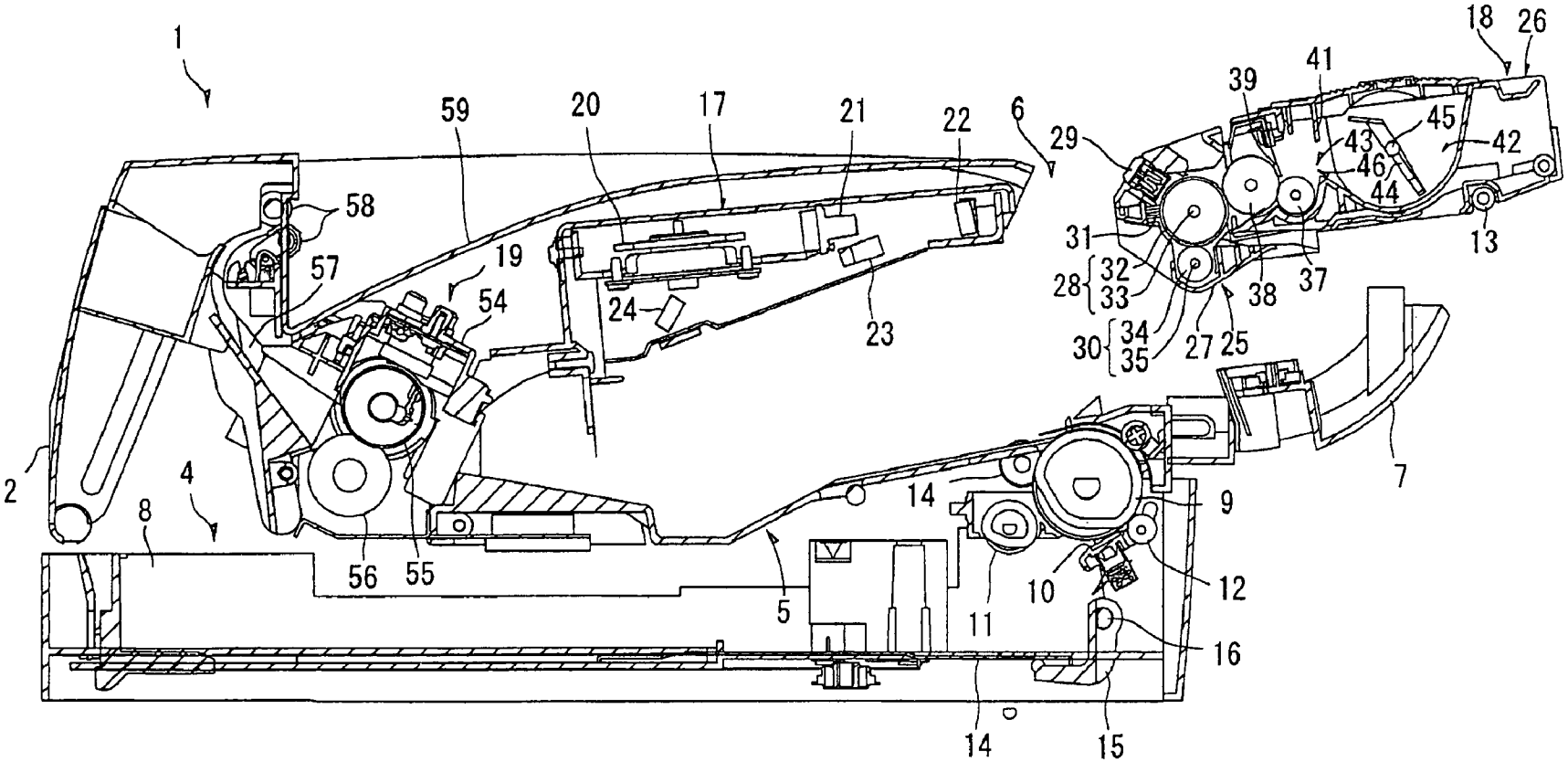
FIG. 2 is a side cross-sectional view of the laser printer in FIG. 1 when the front cover is in an open state.

FIGS. 1 and 2 are side cross-sectional views of a laser printer 1 serving as the image-forming device of the present invention. The laser printer 1 includes a main casing 2 and, within the main casing 2, a feeder unit 4 for supplying sheets of a paper 3, an image-forming unit 5 for forming images on the paper 3 supplied from the feeder unit 4, and the like.

<Main Casing>

An access opening 6 is formed in one side surface of the main casing 2 for inserting and removing a process cartridge 18 described later. A front cover 7 is disposed on the side surface of the main casing 2 and is capable of opening and closing over the access opening 6.

The front cover 7 is rotatably supported by a cover shaft (not shown) inserted through a bottom end of the front cover 7. When the front cover 7 is rotated closed about the cover shaft, the front cover 7 covers the access opening 6, as shown in FIG. 1. When the front cover 7 is rotated open about the cover shaft (rotated downward), the access opening 6 is exposed, as shown in FIG. 2, enabling the process cartridge 18 to be mounted into or removed from the main casing 2 via the access opening 6.

In the following description, the side of the laser printer 1 on which the front cover 7 is provided will be referred to as the "front side," while the opposite side will be referred to as the "rear side." Further, a direction orthogonal to both of the front-to-rear direction and the vertical direction will be referred to as the "width direction." In addition, the front, rear, left, right, top, and bottom sides of the process cartridge 18 (and a developer cartridge 26) described later will be described based on the state of the process cartridge 18 mounted in the main casing 2.

<Feeding Unit>

The feeder unit 4 includes a paper tray 8 detachably mounted in a lower section of the main casing 2, a feeding roller 9 and separating pad 10 disposed above a front end of the paper tray 8, a pickup roller 11 disposed to the rear side of the feeding roller 9, a pinch roller 12 disposed in confrontation with the feeding roller 9 at the lower front surface thereof, and a pair of registration rollers 13 disposed above and rearward of the feeding roller 9.

A paper-pressing plate 14 is provided inside the paper tray 8 for supporting the paper 3 in a stacked state. The paper-pressing plate 14 is pivotably supported on the rear end thereof, so that the front end can pivot downward to a resting position in which the paper-pressing plate 14 rests on a bottom plate of the paper tray 8 and can pivot upward to a supplying position in which the paper-pressing plate 14 is at a slope.

A lever 15 is provided in the front section of the paper tray 8 for lifting the front end of the paper-pressing plate 14 upward. The lever 15 has a substantially L-shaped cross section in order to bend around the front end of the paper-pressing plate 14 and extend under the bottom surface of the same. The top end of the lever 15 is attached to a lever shaft 16 disposed on the front end of the paper tray 8, while the rear end of the lever 15 contacts the bottom surface of the paper-pressing plate 14 near the front end thereof. When a driving force is inputted into the lever shaft 16, the lever 15 rotates about the lever shaft 16 so that the rear end of the lever 15 lifts the front end of the paper-pressing plate 14 upward, shifting the paper-pressing plate 14 from the resting position to the supplying position.

When the paper-pressing plate 14 is in the supplying position, the topmost sheet of the paper 3 stacked on the paper-pressing plate 14 is pressed against the feeding roller 11. The rotating feeding roller 11 begins feeding the sheets of paper 3 between the separating roller 9 and separating pad 10.

When the paper tray 8 is removed from the main casing 2, the front end of the paper-pressing plate 14 drops downward of its own accord into the resting position. In this state, the paper 3 can be loaded in a stacked state on the paper-pressing plate 14.

When the pickup roller 11 conveys a sheet of the paper 3 between the feeding roller 9 and separating pad 10, the paper 3 becomes interposed between the feeding roller 9 and separating pad 10 by the rotation of the feeding roller 9 and is reliably separated and fed one sheet at a time. The fed sheets of paper 3 pass between the feeding roller 9 and pinch roller 12 and are conveyed to the registration rollers 13.

After adjusting the registration of the paper 3, the registration rollers 13 convey the sheet of paper 3 to a transfer position in the image-forming unit 5 (a position between a photosensitive drum 28 and a transfer roller 30 described later at which a toner image formed on the photosensitive drum 28 is transferred onto the paper 3).

<Image-Forming Unit>

The image-forming unit 5 includes a scanning unit 17, the process cartridge 18, and a fixing unit 19.

(1) Scanning Unit

The scanning unit 17 is disposed in the top section of the main casing 2 and includes a laser light source (not shown), a polygon mirror 20 that can be driven to rotate, a fθ lens 21, a reflecting mirror 22, a lens 23, and a reflecting mirror 24. The laser light source emits a laser beam based on image data. As illustrated by a dotted line in FIG. 1, the laser beam is deflected by the polygon mirror 20, passes through the fθ lens 21, is reflected by the reflecting mirror 22, passes through the lens 23, and is reflected downward by the reflecting mirror 24 to be irradiated on the surface of the photosensitive drum 28 described later of the process cartridge 18 in a high-speed scan.

(2) Process Cartridge

The process cartridge 18 is detachably mounted in the main casing 2 beneath the scanning unit 17. The process cartridge 18 includes a drum cartridge 25, and the developer cartridge 26 that is detachably mounted on the drum cartridge 25.

The developer cartridge 26 can be mounted in or removed from the main casing 2 together with the drum cartridge 25, or can be mounted in or removed from the main casing 2 by itself while the drum cartridge 25 is mounted in the main casing 2.

The drum cartridge 25 includes a drum side casing 27. The developer cartridge 26 is mounted on the front portion of the drum side casing 27. In the rear portion of the drum side casing 27, the drum cartridge 25 includes the photosensitive drum 28, a Scorotron charger 29, the transfer roller 30, and a cleaning brush 31.

The photosensitive drum 28 includes a main drum body 32 that is cylindrical in shape and has a positive charging photosensitive layer formed of polycarbonate or the like on the outer surface thereof, and a metal drum shaft 33 extending along the axial center of the main drum body 32 in the longitudinal direction thereof. The drum shaft 33 is rotatably supported in the drum side casing 27 so that the photosensitive drum 28 can rotate in the drum side casing 27 about the drum shaft 33. During an image-forming process, the photosensitive drum 28 rotates clockwise in FIG. 1.

The charger 29 is supported on the drum side casing 27 diagonally above and rearward of the photosensitive drum 28. The charger 29 is disposed in opposition to the photosensitive drum 28 from a prescribed distance so as not to contact the same. The charger 29 includes a discharge wire and a grid for controlling the amount of corona discharge from the discharge wire that reaches the surface of the photosensitive drum 28 to charge the surface with a uniform positive polarity.

The transfer roller 30 is disposed in the drum side casing 27 beneath the photosensitive drum 28 and opposes and contacts the photosensitive drum 28 to form a nip part therewith. The transfer roller 30 is configured of a metal transfer roller shaft 34 that is covered with a roller 35 formed of an electrically conductive rubber material. The roller shaft 34 is rotatably supported in the drum side casing 27. During a transfer operation, the transfer roller 30 is driven to rotate counterclockwise in FIG. 1, while a transfer bias is applied to the transfer roller 30.

The cleaning brush 31 is disposed rearward of the photosensitive drum 28 so that a tip of the brush is in contact with the surface of the main drum body 32 of the photosensitive drum 28.

Figure 3:
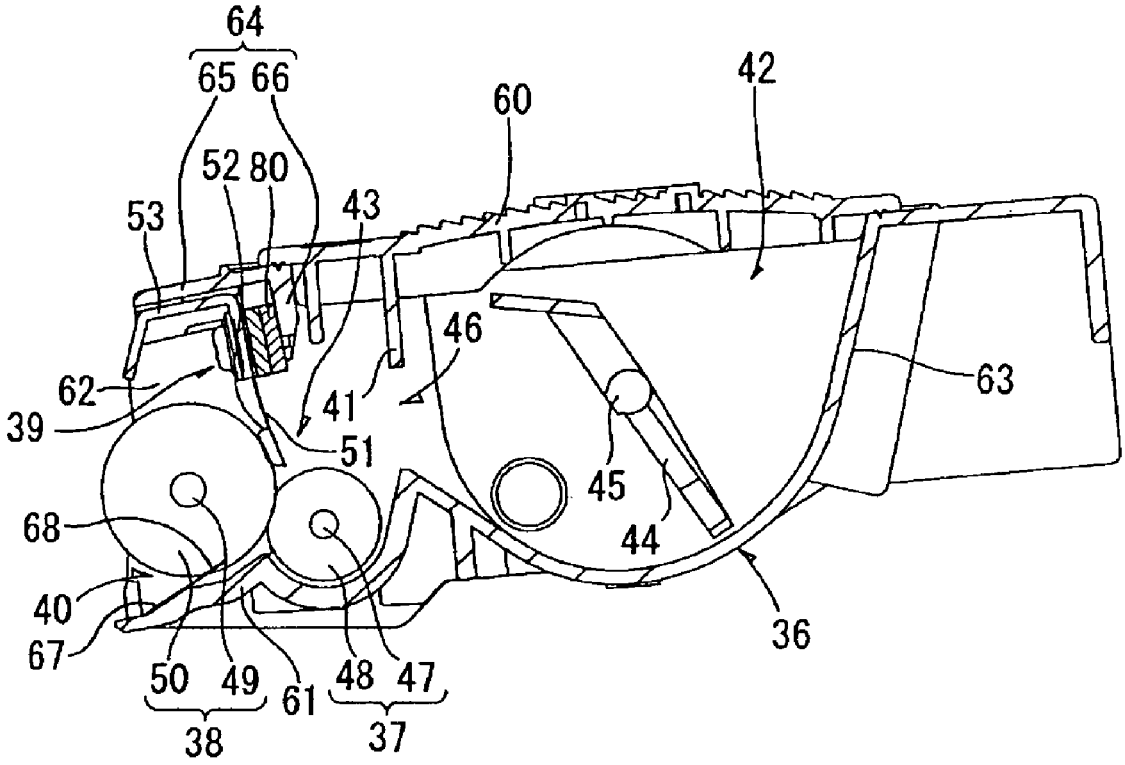
FIG. 3 is a side cross-sectional view of a developer cartridge provided in the laser printer of FIG. 1.

FIG. 3 is a side cross-sectional view of the developer cartridge 26. The developer cartridge 26 includes a developer side casing 36 and, within the developer side casing 36, a supply roller 37, a developing roller 38, and a thickness-regulating blade 39.

The developer side casing 36 is formed in a box shape having an elongated opening 40 formed in the rear side thereof. A partitioning wall 41 is provided in the developer side casing 36 for partitioning the interior of the developer side casing 36 into a toner-accommodating chamber 42, and a developing chamber 43.

The toner-accommodating chamber 42 is filled with a non-magnetic, single-component toner having a positive charge. The toner used in the preferred embodiment is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape in order to have excellent fluidity for achieving high-quality image formation.

This type of toner is compounded with a coloring agent, such as carbon black, or wax, as well as an additive such as silica to improve fluidity. The average diameter of the toner particles is about 6-10 μm.

An agitator shaft 45 is disposed in the center of the toner-accommodating chamber 42 and extends in the width direction. An agitator 44 is supported on the agitator shaft 45 for rotating about the agitator shaft 45 to stir toner inside the toner-accommodating chamber 42. While agitating toner in the toner-accommodating chamber 42, the agitator 44 discharges some of the toner through an opening 46 formed below the partitioning wall 41.

The supply roller 37 is disposed diagonally rearward and below the opening 46. The supply roller 37 includes a metal supply roller shaft 47 that is covered by a sponge roller 48 formed of an electrically conductive foam material. The supply roller shaft 47 is rotatably supported in both side walls of the developer side casing 36 in the developing chamber 43.

The developing roller 38 is disposed rearward of the supply roller 37 and contacts the supply roller 37 with pressure so that both are compressed. The developing roller 38 includes a metal developing roller shaft 49, and a roller 50 formed of an electrically conductive rubber material that covers the developing roller shaft 49. The developing roller shaft 49 is rotatably supported in the developing chamber 43 in both side walls of the developer side casing 36. The roller 50 is more specifically formed of an electrically conductive urethane rubber or silicon rubber containing fine carbon particles or the like, the surface of which is coated with urethane rubber or silicon rubber containing fluorine. A developing bias is applied to the developing roller 38 during a developing operation.

The thickness-regulating blade 39 includes a main blade member 51 configured of a metal leaf spring member, a pressing part 52 provided on a distal end of the main blade member 51, and a blade holder 53 for holding the main blade member 51. The pressing part 52 has a semicircular cross section and is formed of an insulating silicon rubber. The blade holder 53 is mounted in a blade mounting part 64 described later of the developer side casing 36, while the elastic force of the main blade member 51 causes the pressing part 52 to contact the surface of the developing roller 38 with pressure at a position above the supply roller 37.

During a developing operation, the supply roller 37 rotates counterclockwise in FIG. 2, while the developing roller 38 also rotates counterclockwise in FIG. 2.

Toner discharged toward the developing chamber 43 through the opening 46 is supplied onto the roller 50 of the developing roller 38 by the rotating supply roller 37. At this time, the toner is positively tribocharged between the sponge roller 48 of the supply roller 37 and the roller 50 of the developing roller 38. As the developing roller 38 rotates, toner supplied to the surface of the roller 50 passes between the roller 50 and the pressing part 52 of the thickness-regulating blade 39, thereby maintaining a uniform thickness of toner on the surface of the developing roller 38.

In the meantime, as shown in FIG. 1, the charger 29 charges the surface of the photosensitive drum 28 with a uniform positive polarity. Subsequently, a laser beam emitted from the scanning unit 17 is scanned at a high speed over the surface of the photosensitive drum 28, forming an electrostatic latent image on the photosensitive drum 28 corresponding to an image that will be formed on the paper 3.

Next, positively charged toner carried on the surface of the developing roller 38 comes into contact with the photosensitive drum 28 as the developing roller 38 rotates and is supplied to areas on the surface of the positively charged photosensitive drum 28 that were exposed to the laser beam and, therefore, have a lower potential. In this way, the latent image on the photosensitive drum 28 is transformed into a visible image according to a reverse development process so that a toner image is carried on the surface of the photosensitive drum 28.

As the registration rollers 13 convey a sheet of the paper 3 through a transfer position between the photosensitive drum 28 and transfer roller 30, the toner image carried on the surface of the photosensitive drum 28 is transferred onto the paper 3 by a transfer bias applied to the paper 3.

Toner remaining on the surface of the photosensitive drum 28 after the transfer operation is recovered by the developing roller 38. Further, paper dust deposited on the photosensitive drum 28 from the paper 3 is removed from the surface of the photosensitive drum 28 by the cleaning brush 31.

(3) Fixing Unit

The fixing unit 19 is disposed rearward of the process cartridge 18 and includes a fixed frame 54; and a heating roller 55 and a pressure roller 56 provided within the fixed frame 54.

The heating roller 55 includes a metal tube, the surface of which has been coated with a fluorine resin, and a halogen lamp disposed inside the metal tube for heating the same. The heating roller 55 is driven to rotate clockwise in FIG. 1.

The pressure roller 56 is disposed below and in opposition to the heating roller 55 and contacts the heating roller 55 with pressure. The pressure roller 56 is configured of a metal roller shaft covered with a roller that is formed of a rubber material. The pressure roller 56 follows the rotational drive of the heating roller 55.

In the fixing unit 19, toner transferred onto the paper 3 at the transfer position is fixed to the paper 3 by heat as the paper 3 passes between the heating roller 55 and pressure roller 56. After the fixing process, the paper 3 is conveyed along a discharge path 57 that extends in a sloped direction toward the top surface of the main casing 2. Discharge rollers 58 are provided at the top end of the discharge path 57. The discharge rollers 58 receive the paper 3 conveyed along the discharge path 57 and discharge the paper 3 onto a discharge tray 59 formed on the top surface of the main casing 2.

2. Detailed Structure of the Developer Side Casing for the Developer Cartridge

Figure 4:
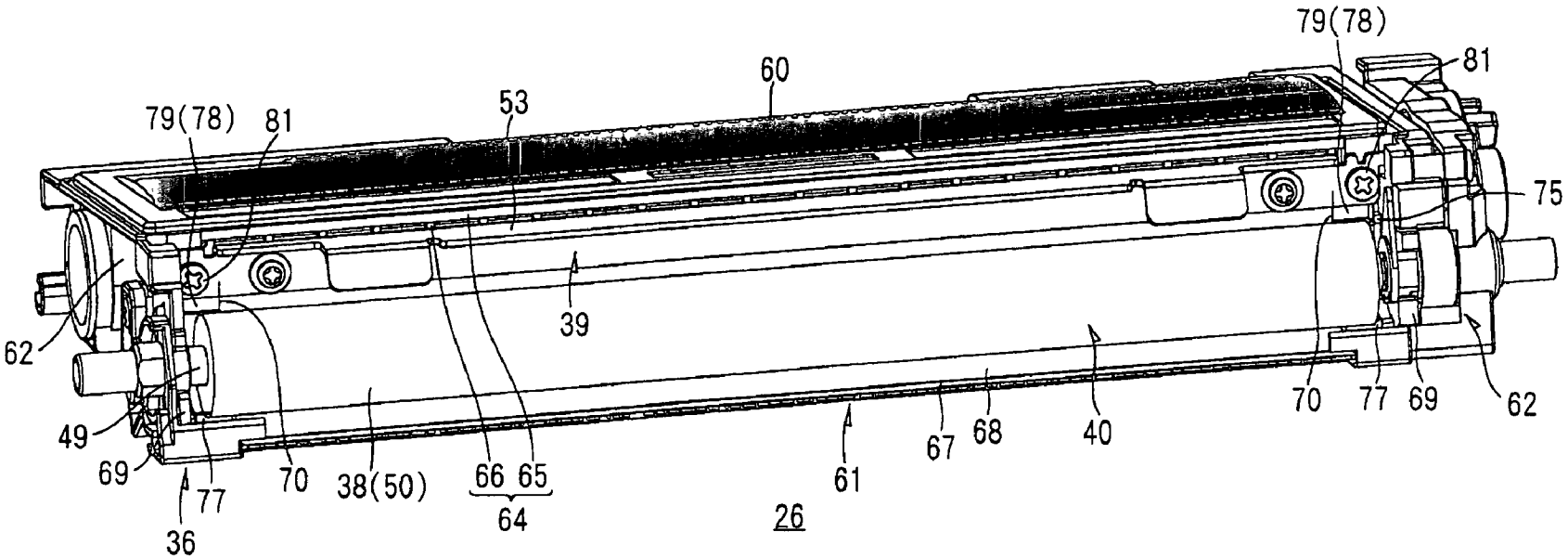
FIG. 4 is a perspective view of the developer cartridge in FIG. 3 from the rear side (side on which the developing roller is provided)
Figure 5:
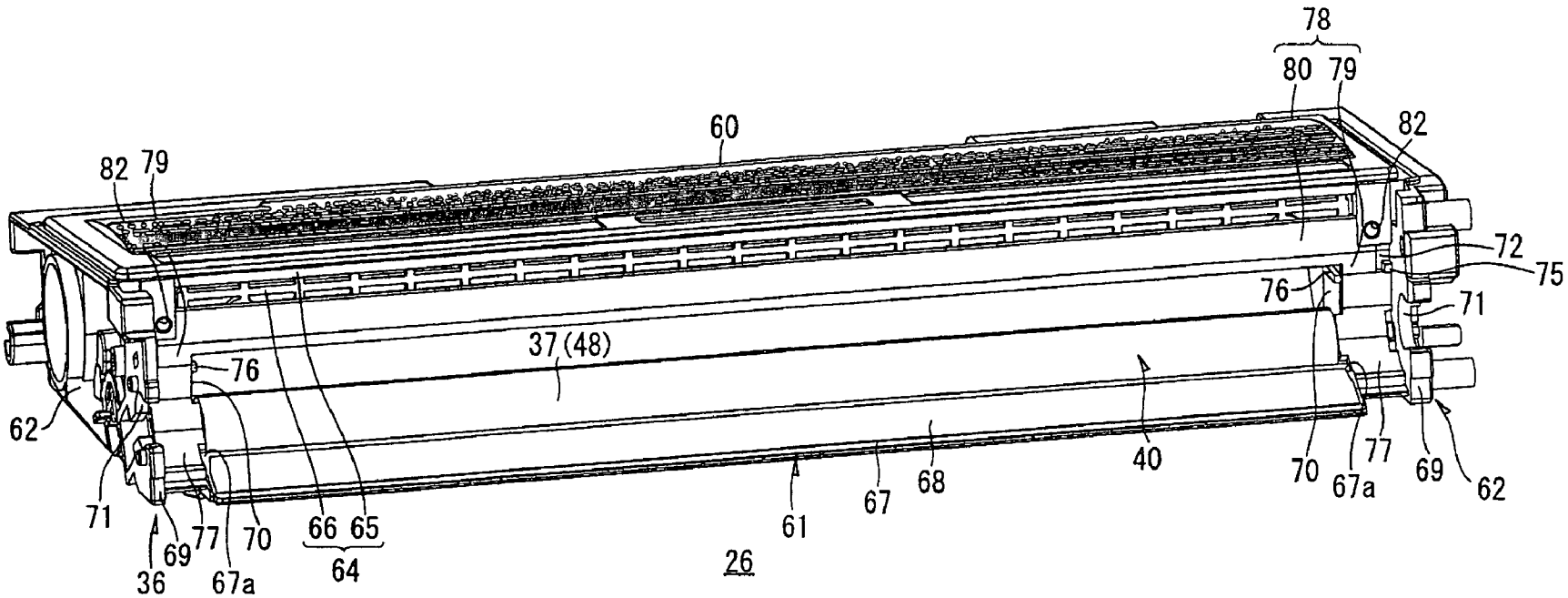
FIG. 5 is a perspective view of the developer cartridge in FIG. 3 when the developing roller has been removed.
Figure 6:
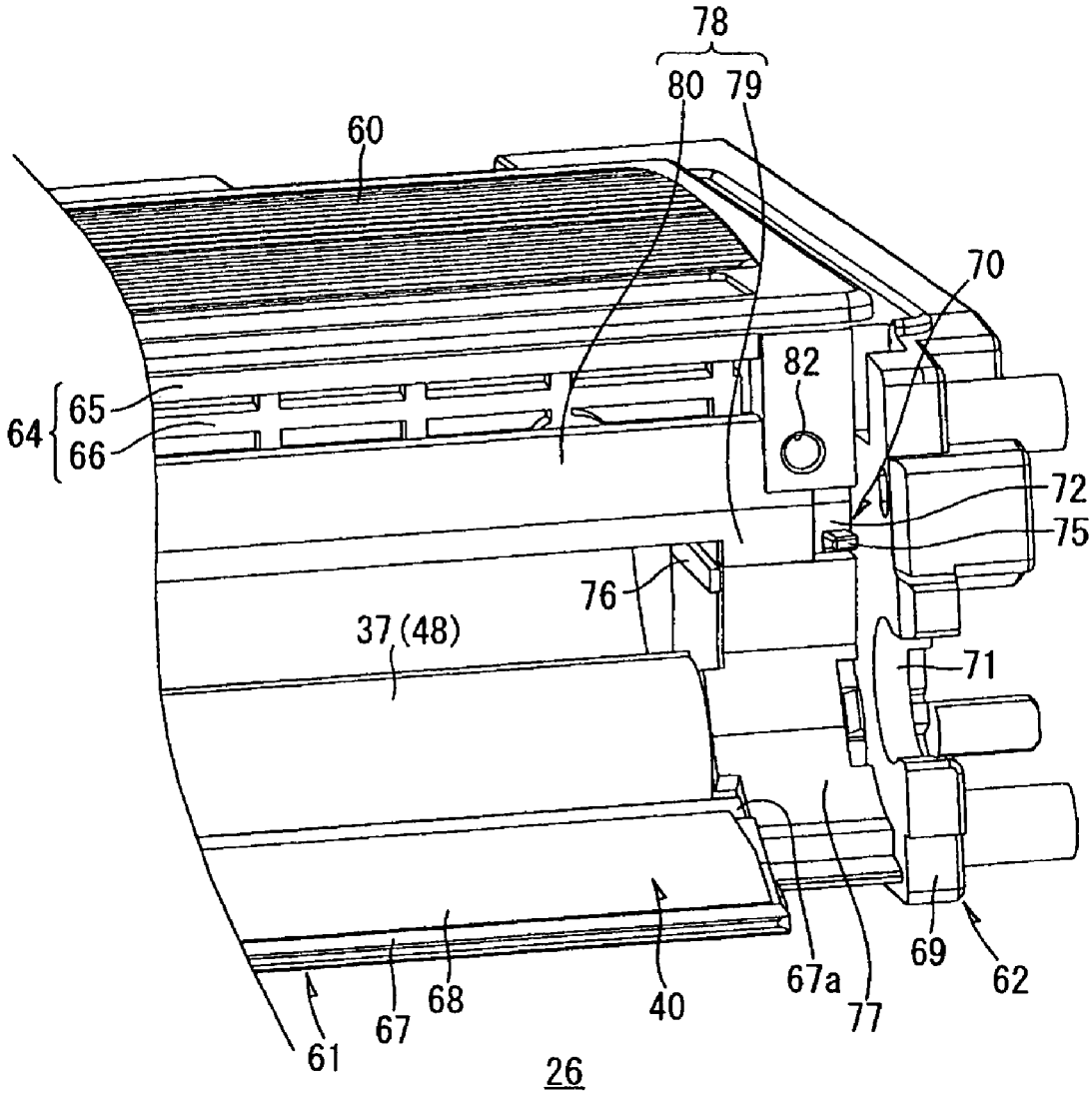
FIG. 6 is a perspective view showing the rear side of the developer cartridge in FIG. 3 on one widthwise end thereof.
Figure 7:
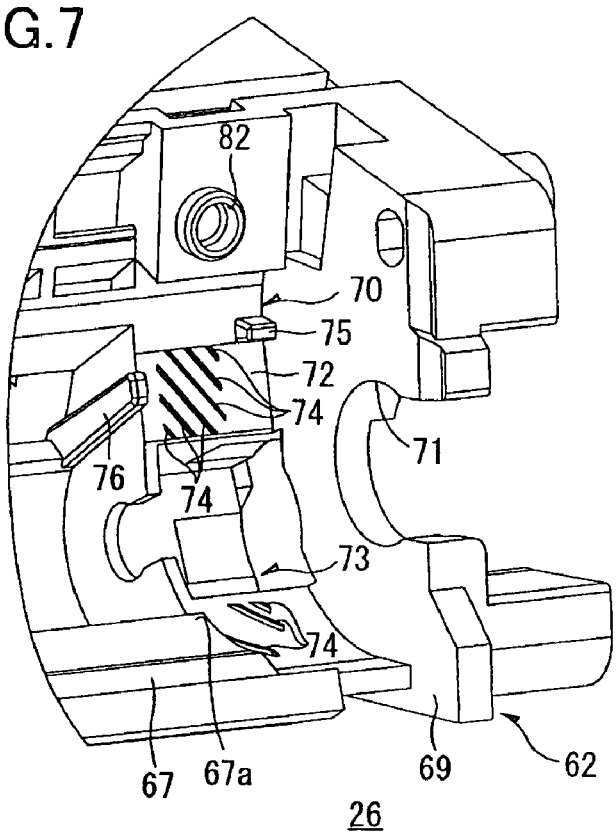
FIG. 7 is a perspective view showing a rear side of a developer side casing of the developer cartridge in FIG. 3 on one widthwise end thereof.

FIG. 4 is a perspective view of the developer cartridge 26 from the rear side (side on which the developing roller 38 is provided). FIG. 5 is a perspective view of the developer cartridge 26 when the developing roller 38 has been removed. FIG. 6 is a perspective view showing the rear side of the developer cartridge 26 on one widthwise end thereof. FIG. 7 is a perspective view showing a rear side of the developer side casing 36 of the developer cartridge 26 on one widthwise end thereof.

<Developer Side Casing>

The developer side casing 36 of the developer cartridge 26 includes a top wall 60 and bottom wall 61 that oppose each other vertically; a pair of side walls 62 for closing off the widthwise sides of the developer side casing 36 between the top wall 60 and bottom wall 61; and a front wall 63 (see FIG. 3) for closing off the front side of the developer side casing 36 between the top wall 60 and bottom wall 61.

The top wall 60 is plate-shaped and wider than the distance between the opposing side walls 62 so as to span between the upper edges of the side walls 62. The blade mounting part 64 is provided on the rear end of the top wall 60 for mounting the thickness-regulating blade 39. The opening 40 elongated in the width direction is defined by the blade mounting part 64, bottom wall 61, and side walls 62.

The blade mounting part 64 is L-shaped in cross section. More specifically, the blade mounting part 64 is integrally formed of a plate-shaped upper mounting part 65 opposing the bottom wall 61 of the developer side casing 36, and a lattice-shaped front mounting part 66 bent downward substantially at a right angle from the front edge of the upper mounting part 65. The upper mounting part 65 occupies a horizontal plane and is elongated in the width direction, while the front mounting part 66 occupies a vertical plane and is also elongated in the width direction.

As shown in FIG. 3, the front end of the bottom wall 61 extends diagonally upward and forward and is formed continuously with the front wall 63. A film mounting part 67 is formed on the upper rear surface of the bottom wall 61 extending in the axial direction of the developing roller 38. A lower film 68 is provided on the film mounting part 67. The lower film 68 is formed of polyethylene terephthalate for sliding against the peripheral surface of the roller 50 on the developing roller 38 while contacting this surface uniformly across the entire width of the roller 50. By sliding uniformly over the peripheral surface of the roller 50 at a position above the bottom wall 61, the lower film 68 can prevent toner from leaking through the bottom wall 61 and the developing roller 38.

As shown in FIG. 4, each of the side walls 62 includes a supporting plate 69 for supporting the developing roller shaft 49 of the developing roller 38 so that the developing roller 38 is exposed in the opening 40; and a seal mounting part 70 for mounting seals described later.

Each supporting plate 69 is plate-shaped and extends vertically. As shown in FIGS. 5 through 7, a bearing hole 71 is formed in each supporting plate 69 for receiving the developing roller shaft 49 of the developing roller 38. The bearing hole 71 is U-shaped in a side view. The bearing hole 71 opens on the rear side in order to receive the developing roller shaft 49 of the developing roller 38 through this opening.

The seal mounting part 70 is disposed adjacent to the supporting plate 69 and inside the supporting plate 69 in the width direction (the inner side in the axial direction of the developing roller 38). The seal mounting part 70 has a roller-confronting surface 72 that opposes the peripheral surface of the roller 50 on a widthwise end of the developing roller 38 and extends in a curved shape along the peripheral surface of the roller 50.

As shown in FIG. 7, a recessed part 73 is formed in a vertical midpoint of the roller-confronting surface 72 for receiving the supply roller shaft 47 of the supply roller 37. The recessed part 73 is recessed in the roller-confronting surface 72 in a direction obliquely forward. A sponge member (not shown) is disposed on the recessed part 73 to fill a gap between the supply roller shaft 47 and a surface of the recessed part 73 when the supply roller shaft 47 is received.

A plurality of rib-shaped protruding parts 74 is formed in the upper and lower parts of the roller-confronting surface 72 separated by the recessed part 73. The protruding parts 74 are parallel to one another and spaced at prescribed intervals. The protruding parts 74 are slanted with respect to the width direction, angling inward in the width direction from the upstream side to the downstream side in the rotating direction of the developing roller 38, that is, upward in FIG. 7. Further, a downstream contact part 75 protrudes from the top end of the roller-confronting surface 72 for contacting a side seal 77 described later from the top (from the downstream side in the rotating direction of the developing roller 38).

Each side wall 62 also has an axial contact part 76 for contacting the side seal 77 described later from the inner side in the axial direction of the developing roller 38. The axial contact part 76 is disposed on the opposite side of the seal mounting part 70 from the supporting plate 69 and extends in the front-to-rear direction so that the rear end (free end) protrudes farther rearward than the roller-confronting surface 72. The axial contact part 76 does not protrude over the side seal 77.

<Side Seal>

As shown in FIG. 6, the side seal 77 mentioned above is disposed on the roller-confronting surface 72 of the seal mounting part 70 to prevent toner from leaking between the roller-confronting surface 72 and an end of the roller 50.

The side seal 77 is formed of a sponge material such as urethane foam. The side seal 77 is fitted between the downstream contact part 75 and a rear corner part 67*a* of the film mounting part 67, and between the supporting plate 69 and the axial contact part 76.

More specifically, the side seal 77 extends vertically along the rotating direction of the developing roller 38 over the roller-confronting surface 72. The upper endface of the side seal 77 contacts the downstream contact part 75. A rectangular-shaped corner part is cut out from the inner axial side of the side seal 77 on the lower end thereof. The rear corner part 67*a* of the film mounting part 67 is inserted into this cutout part such that a small gap is formed between the side seal 77 and the rear corner part 67*a* in the front-to-rear direction. The outer endface of the side seal 77 in the width direction contacts the supporting plate 69, while the axial contact part 76 contacts the inner endface of the side seal 77 in the width direction. The rear corner part 67*a* does not protrude over the side seal 77.

Accordingly, the downstream contact part 75 and the rear corner part 67*a* position the side seal 77 in the rotating direction of the developing roller 38, while the supporting plate 69 and the axial contact part 76 position the side seal 77 in the axial direction of the developing roller 38 (width direction).

The side seal 77 slides along the peripheral surface of the roller 50 in order to prevent toner from leaking between the roller 50 and roller-confronting surface 72.

<Blade Seal>

In the developer cartridge 26 of the preferred embodiment, a blade seal 78 is disposed over the front mounting part 66 of the blade mounting part 64 and the upper ends of the seal mounting parts 70.

The blade seal 78 is formed of a sponge material, such as urethane foam. As shown in FIG. 5, the blade seal 78 is integrally formed of side parts 79 disposed on the upper ends of the roller-confronting surfaces 72 on the seal mounting parts 70; and a connecting part 80 for linking the side parts 79.

The blade seal 78 is formed shorter in the width direction than the gap between the downstream contact parts 75 disposed on each widthwise end so that a small gap is formed between each side part 79 of the blade seal 78 and the corresponding downstream contact part 75. Lower endfaces of the side parts 79 are in contact with upper endfaces of the side seals 77. More specifically, each side part 79 contacts an upper endface of the side seal 77 from the downstream side in the rotating direction of the developing roller 38 and at a region separated from the region of the side seal 77 contacting the downstream contact part 75.

The thickness-regulating blade 39 is mounted on the blade mounting part 64 by placing the blade holder 53 against the front mounting part 66 of the blade mounting part 64 with the blade seal 78 interposed therebetween, inserting screws 81 (see FIG. 4) through the thickness-regulating blade 39 and blade seal 78 from the rear side of the blade holder 53, and screwing the screws 81 into screw holes 82 formed in the developer side casing 36. In this state, the blade seal 78 is interposed between the blade holder 53 of the thickness-regulating blade 39 and the front mounting part 66 of the blade mounting part 64, thereby sealing the gap therebetween.

3. Operations and Effects of the Preferred Embodiment

By providing the side seals 77 on the roller-confronting surfaces 72 of the seal mounting parts 70 opposing the peripheral surface of the roller 50 on both ends of the developing roller 38, it is possible to prevent toner from leaking between the ends of the roller 50 and the roller-confronting surfaces 72. Further, a plurality of protruding parts 74 extending in a direction that crosses the axial direction of the developing roller 38 is formed on the roller-confronting surfaces 72. Accordingly, even if toner gets between the roller-confronting surface 72 and side seal 77, the protruding parts 74 block passage of the toner therethrough, thereby reliably preventing toner from leaking between the end portions of the roller 50 and the roller-confronting surfaces 72.

Further, the protruding parts 74 extend at an angle to the width direction that slants inward in the width direction (the axial direction of the developing roller 38) from the upstream to the downstream side in the rotational direction of the developing roller 38. Hence, the force that the side seal 77 receives from the roller 50 as the developing roller 38 rotates can be converted to a force sloping inward in the width direction. Hence, the portion of the side seals 77 on the inner widthwise side can be firmly pushed against the roller-confronting surfaces 72 of the developer side casing 36. Further, even if toner works between the roller-confronting surface 72 and side seal 77, the protruding parts 74 can guide the toner toward the inside of the developer side casing 36, thereby more reliably preventing toner from leaking between the roller-confronting surface 72 and side seal 77.

The downstream contact parts 75 are also provided for contacting the side seals 77 disposed on the roller-confronting surfaces 72 from the downstream end in the rotating direction of the developing roller 38. Accordingly, the side seals 77 are easily positioned on the roller-confronting surfaces 72 with reference to the downstream contact parts 75.

Further, the downstream contact parts 75 can prevent the side seals 77 from shifting downstream in the rotating direction.

Further, the rear corner part 67*a* of the film mounting part 67 opposes the side seal 77 over a small gap from the upstream side in the rotating direction of the developing roller 38. Accordingly, the side seal 77 is easily positioned on the roller-confronting surface 72 with reference to the rear corner part 67*a* of the film mounting part 67, as well as the downstream contact part 75. Further, the rear corner part 67*a* of the film mounting part 67 and the downstream contact part 75 can position the side seal 77 in the rotating direction of the developing roller 38.

Further, the supporting plate 69 of the side walls 62 and the axial contact part 76 are disposed on both sides of the side seal 77 in the width direction for positioning the side seal 77 in the width direction.

The side seal 77 is mounted on the roller-confronting surface 72 so as to be fitted between the downstream contact part 75 and the rear corner part 67*a* and between the supporting plate 69 and the axial contact part 76. Further, the small gap is formed between the side seal 77 and the rear corner part 67*a*. Accordingly, the side seal 77 can easily be removed from the roller-confronting surface 72 when recycling the developer cartridge 26, thereby making the developer cartridge 26 more suitable for recycling.

Further, the blade seal 78 is provided for preventing toner from leaking between the blade holder 53 of the thickness-regulating blade 39 and the front mounting part 66 of the blade mounting part 64. If a gap is formed between the side seals 77 and blade seal 78, toner can escape through the gap. However, the blade seal 78 in the preferred embodiment circumvents the downstream contact part 75 and contacts a portion of the side seal 77 that is not in contact with the downstream contact part 75, thereby preventing toner from leaking between the side seal 77 and blade seal 78.

Since the process cartridge 18 of the preferred embodiment is provided with the developer cartridge 26, which is capable of reliably preventing toner from leaking between both ends of the roller 50 on the developing roller 38 and the roller-confronting surfaces 72, the process cartridge 18 can also prevent toner from leaking from the developer cartridge 26. Further, the laser printer 1 in which the process cartridge 18 is mounted can prevent toner from leaking from the developer cartridge 26 and process cartridge 18.

4. Variations of the Embodiment

While the invention has been described in detail with reference to the specific embodiment thereof, it would be apparent to those skilled in the art that various changes and modifications may be made therein without departing from the spirit of the invention.

Figure 8:
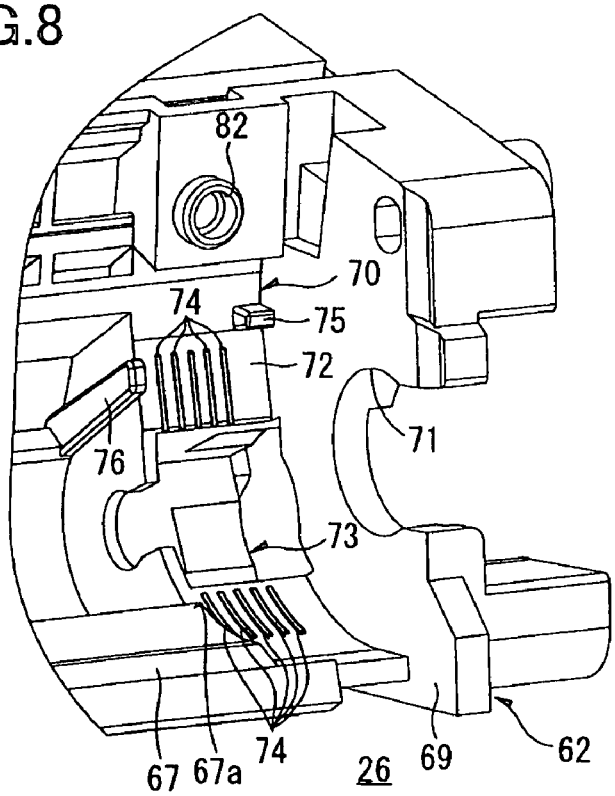
FIG. 8 is a perspective view showing protruding parts in the developer side casing according to a variation of the preferred embodiment.

For example, in the preferred embodiment described above, the protruding parts 74 extend at an angle to the width direction that slants inward in the width direction from the upstream to the downstream side in the rotating direction of the developing roller 38. However, the protruding parts 74 may be formed to extend in a direction along the rotating direction of the developing roller 38 (a direction orthogonal to the width direction), as shown in FIG. 8. In other words, toner that has worked between the roller-confronting surface 72 and side seal 77 can be prevented from passing through when the protruding parts 74 extend in a direction along the rotating direction of the developing roller 38, or any direction crossing the axial direction of the developing roller 38 (the width direction).

Accordingly, the protruding parts 74 can reliably prevent toner from leaking between the roller-confronting surfaces 72 and both ends of the roller 50 on the developing roller 38.

In addition, the protruding part 74 has only to include one part crossing the rotating direction.

What is claimed is:

1. A developer cartridge comprising:

a developer roller having a rotational axis and a peripheral surface, the peripheral surface including a center zone and an end zone at one end portion in an axial direction;

a support member that supports the developer roller to be rotatable about the rotational axis, the support member having an opposing surface opposed to the end zone, wherein a plurality of protrusions each having a rib shape extending in a direction crossing with the axial direction is formed on the opposing surface, a recess being formed between adjacent protrusions; and a first seal member disposed between the end zone and the plurality of protrusions in order to prevent developer from leaking out of the recess.

2. The developer cartridge according to claim 1, wherein the protrusion having a first end and a second end farther from the central zone than the first end in the axial direction, the first end of the protrusion being formed in an upstream side of the second end of the protrusion with respect to a rotational direction of the developer roller.

3. The developer cartridge according to claim 1, wherein the protrusion extends in the rotational direction.

4. The developer cartridge according to claim 1, wherein the support member has a contacting member that contacts the first seal member from a downstream in the rotational direction.

5. The developer cartridge according to claim 4, further comprising:

a thickness-regulating member having a first part attached to the support member and a second part that regulates thickness of the developer provided on the peripheral surface; and a second seal member disposed between the support member and the first part in order to prevent the developer from leaking out of a space formed between the support member and the first part.

6. The developer cartridge according to claim 5, wherein the second seal member contacts the first seal member in order to prevent the developer from leaking out of a space formed between the first seal member and the second seal member.

7. The developer cartridge according to claim 6, wherein the second seal member contacts the first seal member from a downstream in the rotational direction while avoiding the contacting member.

8. The developer cartridge according to claim 1, wherein the support member has a first opposing portion opposed to the first sealing member from an upstream of the rotational direction.

9. The developer cartridge according to claim 8, wherein the first opposing portion is opposed to the first sealing member with a predetermined space interposed therebetween.

10. The developer cartridge according to claim 1, wherein the support member has a second opposing portion opposed to the first sealing member in the axial direction.

11. The developer cartridge according to claim 1, wherein the first sealing member is fit in the opposing surface.

12. A developer cartridge comprising:

a developer roller having a rotational axis, and a peripheral surface, the peripheral surface including a center zone and an end zone at one end portion in an axial direction;

a support member that supports the developer roller to be rotatable about the rotational axis, the support member having an opposing surface opposed to the end zone, wherein a plurality of protrusions each having a rib shape, a first end and a second end farther from the central zone than the first end in the axial direction is formed on the opposing surface, each first end being formed in an upstream side of the corresponding second end with respect to a rotational direction of the developer roller, a recess being formed between adjacent protrusions; and a first seal member disposed between the end zone and the plurality of protrusions in order to prevent developer from leaking out of the recess.

13. The developer cartridge according to claim 12, wherein the support member has a contacting member that contacts the first seal member from a downstream in the rotational direction.

14. The developer cartridge according to claim 13, further comprising:

a thickness-regulating member having a first part attached to the support member and a second part that regulates thickness of the developer provided on the peripheral surface; and a second seal member disposed between the support member and the first part in order to prevent the developer from leaking out of a space formed between the support member and the first part.

15. The developer cartridge according to claim 14, wherein the second seal member contacts the first seal member in order to prevent the developer from leaking out of a space formed between the first seal member and the second seal member.

16. The developer cartridge according to claim 15, wherein the second seal member contacts the first seal member from a downstream in the rotational direction while avoiding the contacting member.

17. The developer cartridge according to claim 13, wherein the support member has a first opposing portion opposed to the first sealing member from an upstream of the rotational direction.

18. The developer cartridge according to claim 17, wherein the first opposing portion is opposed to the first sealing member with a predetermined space interposed therebetween.

19. The developer cartridge according to claim 13, wherein the support member has a second opposing portion opposed to the first sealing member in the axial direction.

20. The developer cartridge according to claim 13, wherein the first sealing member is fit in the opposing surface.

21. A process cartridge comprising: a developer cartridge comprising:

a developer roller having a rotational axis and a peripheral surface, the peripheral surface including a center zone and an end zone at one end portion in an axial direction;

a support member that supports the developer roller to be rotatable about the rotational axis, the support member having an opposing surface opposed to the end zone, wherein a plurality of protrusions each having a rib shape extending in a direction crossing with the axial direction is formed on the opposing surface, a recess being formed between adjacent protrusions; and a first seal member disposed between the end zone and the plurality of protrusions in order to prevent developer from leaking out of the recess; and an image-bearing member on which the toner is provided from the developer cartridge.

22. The process cartridge according to claim 21, wherein the protrusion having a first end and a second end farther from the central zone than the first end in the axial direction, the first end of the protrusion being formed in an upstream side of the second end of the protrusion with respect to a rotational direction of the developer roller.

23. The process cartridge according to claim 21, wherein the protrusion extends in the rotational direction.

24. A process cartridge comprising:

a developer cartridge comprising: a developer roller having a rotational axis, and a peripheral surface, the peripheral surface including a center zone and an end zone at one end portion in an axial direction;

a support member that supports the developer roller to be rotatable about the rotational axis, the support member having an opposing surface opposed to the end zone, wherein a plurality of protrusions each having a rib shape, a first end and a second end farther from the central zone than the first end in the axial direction is formed on the opposing surface, each first end being formed in an upstream side of the corresponding second end with respect to a rotational direction of the developer roller, a recess being formed between adjacent protrusions; and a first seal member disposed between the end zone and the plurality of protrusions in order to prevent developer from leaking out of the recess; and an image-bearing member on which the toner is provided from the developer cartridge.

25. An image-forming device comprising:

a developer cartridge comprising:

a developer roller having a rotational axis and a peripheral surface, the peripheral surface including a center zone and an end zone at one end portion in an axial direction;

a support member that supports the developer roller to be rotatable about the rotational axis, the support member having an opposing surface opposed to the end zone, wherein a plurality of protrusions each having a rib shape extending in a direction crossing with the axial direction is formed on the opposing surface, a recess being formed between adjacent protrusions; and a first seal member disposed between the end zone and the plurality of protrusions in order to prevent developer from leaking out of the recess; and a body in which the developer cartridge is mounted.

26. The image-forming device according to claim 25, wherein the protrusion having a first end and a second end farther from the central zone than the first end in the axial direction, the first end of the protrusion being formed in an upstream side of the second end of the protrusion with respect to a rotational direction of the developer roller.

27. The image-forming device according to claim 25, wherein the protrusion extends in the rotational direction.

28. An image-forming device comprising:

a developer cartridge comprising: a developer roller having a rotational axis, and a peripheral surface, the peripheral surface including a center zone and an end zone at one end portion in an axial direction;

a support member that supports the developer roller to be rotatable about the rotational axis, the support member having an opposing surface opposed to the end zone, wherein a plurality of protrusions each having a rib shape, a first end and a second end farther from the central zone than the first end in the axial direction is formed on the opposing surface, each first end being formed in an upstream side of the corresponding second end of the protrusion with respect to a rotational direction of the developer roller, a recess being formed between adjacent protrusions; and a first seal member disposed between the end zone and the plurality of protrusions in order to prevent developer from leaking out of the recess; and a body in which the developer cartridge is mounted.

29. An image-forming device comprising:

a process cartridge comprising:

a developer roller having a rotational axis and a peripheral surface, the peripheral surface including a center zone and an end zone at one end portion in an axial direction;

a support member that supports the developer roller to be rotatable about the rotational axis, the support member having an opposing surface opposed to the end zone, wherein a plurality of protrusions each having a rib shape extending in a direction crossing with the axial direction is formed on the opposing surface, a recess being formed between adjacent protrusions;

a first seal member disposed between the end zone and the plurality of protrusions in order to prevent developer from leaking out of the recess; and an image-bearing member on which the toner is provided from the developer roller; and a body in which the developer cartridge is mounted.

30. The image-forming device according to claim 29, wherein the protrusion having a first end and a second end farther from the central zone than the first end in the axial direction, the first end of the protrusion being formed in an upstream side of the second end of the protrusion with respect to a rotational direction of the developer roller.

31. The image-forming device according to claim 30, wherein the protrusion extends in the rotational direction.

32. An image-forming device comprising:

a process cartridge comprising:

a developer roller having a rotational axis, and a peripheral surface, the peripheral surface including a center zone and an end zone at one end portion in an axial direction;

a support member that supports the developer roller to be rotatable about the rotational axis, the support member having an opposing surface opposed to the end zone, wherein a plurality of protrusions each having a rib shape, a first end and a second end farther from the central zone than the first end in the axial direction is formed on the opposing surface, each first end being formed in an upstream side of the corresponding second end with respect to a rotational direction of the developer roller, a recess being formed between adjacent protrusions;

a first seal member disposed between the end zone and the plurality of protrusions in order to prevent developer from leaking out of the recess; and an image-bearing member on which the toner is provided from the developer roller; and a body in which the developer cartridge is mounted.

* * * * *